US010094589B2

(12) United States Patent
Oohigashi et al.

(10) Patent No.: US 10,094,589 B2
(45) Date of Patent: Oct. 9, 2018

(54) FIN-AND-TUBE TYPE HEAT EXCHANGER AND WATER HEATER INCLUDING THE SAME

(71) Applicant: NORITZ CORPORATION, Hyogo (JP)

(72) Inventors: Takeshi Oohigashi, Kakogawa (JP); Nobuhiro Takeda, Himeji (JP); Masaki Kondo, Himeji (JP); Wataru Ooshita, Himeji (JP); Kosuke Ichiyama, Akashi (JP); Yukiko Noguchi, Kakogawa (JP)

(73) Assignee: NORITZ CORPORATION, Hyogo (JP)

( * ) Notice: Subject to any disclaimer, the term of this patent is extended or adjusted under 35 U.S.C. 154(b) by 0 days.

(21) Appl. No.: 15/324,445

(22) PCT Filed: Jul. 2, 2015

(86) PCT No.: PCT/JP2015/069157
§ 371 (c)(1),
(2) Date: Jan. 6, 2017

(87) PCT Pub. No.: WO2016/013369
PCT Pub. Date: Jan. 28, 2016

(65) Prior Publication Data

US 2017/0205113 A1 Jul. 20, 2017

(30) Foreign Application Priority Data

Jul. 25, 2014 (JP) ..... 2014-151620

(51) Int. Cl.
*F28F 1/10* (2006.01)
*F24H 1/14* (2006.01)
(Continued)

(52) U.S. Cl.
CPC ..... *F24H 1/14* (2013.01); *F24H 9/00* (2013.01); *F28D 1/053* (2013.01); *F28D 7/082* (2013.01);
(Continued)

(58) Field of Classification Search
CPC ..... F28D 7/024; F28D 7/0066; F28D 1/053; F28D 7/082; F28D 21/0007; F28F 1/32; F28F 1/325; F24H 1/14; F24H 9/00
(Continued)

(56) References Cited

U.S. PATENT DOCUMENTS

2007/0204980 A1* 9/2007 Kim ..... F28D 7/0066 165/172
2012/0199331 A1* 8/2012 Maurer ..... F28D 7/024 165/172

FOREIGN PATENT DOCUMENTS

JP S08-003661 Y1 3/1933
JP H04-273946 A 9/1992
(Continued)

OTHER PUBLICATIONS

International Search Report issued in PCT/JP2015/069157; dated Aug. 4, 2015.

*Primary Examiner* — Davis Hwu
(74) *Attorney, Agent, or Firm* — Studebaker & Brackett PC

(57) ABSTRACT

A fin-and-tube type heat exchanger includes: a plurality of plate fins arranged in a case side by side in a fore-and-aft direction of the case; and a heat transfer tube including a plurality of straight-type tubular bodies each passing through these plurality of plate fins. First and second plate fins arranged side by side in the right-and-left width direction of the case are provided as a plurality of plate fins. The heat transfer tube has a connection tubular body connecting the straight-type tubular bodies passing through the first and
(Continued)

second plate fins. The heat transfer tube passes through areas in which the first and second plate fins are arranged.

6 Claims, 7 Drawing Sheets

(51) Int. Cl.

| | |
|---|---|
| ***F24H 9/00*** | (2006.01) |
| ***F28D 1/053*** | (2006.01) |
| ***F28F 1/32*** | (2006.01) |
| ***F28D 7/08*** | (2006.01) |
| ***F28D 21/00*** | (2006.01) |

(52) U.S. Cl.
CPC ..... *F28D 21/0007* (2013.01); *F28F 1/32* (2013.01); *F28F 1/325* (2013.01)

(58) Field of Classification Search
USPC ..... 165/172
See application file for complete search history.

(56) References Cited

FOREIGN PATENT DOCUMENTS

| | | | |
|---|---|---|---|
| JP | H04-117351 | U | 10/1992 |
| JP | H08-159681 | A | 6/1996 |
| JP | H10-019377 | A | 1/1998 |
| JP | 2001-091057 | A | 4/2001 |
| JP | 2003-121008 | A | 4/2003 |
| JP | 2013-011409 | A | 1/2013 |

* cited by examiner

FIN-AND-TUBE TYPE HEAT EXCHANGER AND WATER HEATER INCLUDING THE SAME

TECHNICAL FIELD

The present invention relates to a fin-and-tube type heat exchanger configured such that a heat transfer tube passes through a plurality of plate fins and used for a water heating application and the like, and a water heater including the fin-and-tube type heat exchanger.

BACKGROUND ART

For example, a gas water heater is generally configured to use a fin-and-tube type heat exchanger to recover heat from combustion gas generated by a gas burner for heating water for hot water supply.

If such a gas water heater is configured as a commercial-use water heater, for example, that is used in restaurants and the like and having a relatively high hot-water supply capability (size number) unlike a home-use water heater, a large-scale gas burner covering a large gas combustion area is used. Accordingly, the heat exchanger to be used needs to be of large size in accordance with this gas combustion area. Thus, each plate fin is actually sized to have a considerably increased length in the right-and-left width direction that is approximately equal to the width of the gas combustion area of the gas burner.

Also in the conventional instance, there has been a water heater having a configuration different from that of the above-described water heater. This water heater is configured such that two heat exchangers are stacked vertically in two stages and connected to each other through their heat transfer tubes (for example, see Japanese Patent Laying-Open No. 10-19377).

Furthermore, as another example of the conventional heat exchanger, there has also been a heat exchanger in a 2-circuits-in-1-case system in which two plate fin blocks are arranged in one case (for example, see Japanese Patent Laying-Open No. 2001-91057).

CITATION LIST

Patent Document

PTD 1: Japanese Patent Laying-Open No. 10-19377
PTD 2: Japanese Patent Laying-Open No. 2001-91057

SUMMARY OF INVENTION

Technical Problem

However, the above-described conventional technique causes problems described below.

First, when the length of the plate fin in the right-and-left width direction is set to be approximately equal to the width of the gas combustion area of a gas burner, the following problems occur. Specifically, if a commercial-use water heater with high hot-water supply capability is formed, each plate fin in a heat exchanger needs to be prepared by manufacturing a special-purpose plate fin formed relatively long in the right-and-left width direction, as described above. This considerably increases the manufacturing cost. Also, if a plate fin has a relatively long dimension, the thermal expansion amount obtained by heating by combustion gas is also increased. Accordingly, a relatively large stress is more likely to occur in a plate fin, a heat transfer tube, a joint portion therebetween, and the like. For the purpose of increasing the reliability of the entire heat exchanger, lengthening its durable life, and the like, it is desirable to solve the above-described problems.

Also in the configuration disclosed in Japanese Patent Laying-Open No. 10-19377, when a large-sized burner having a large combustion area is used, each of the plate fins in a heat exchanger needs to be eventually increased in size in accordance therewith. Consequently, the above-described problems cannot still be appropriately solved.

Also, the heat exchanger having a configuration disclosed in Japanese Patent Laying-Open No. 2001-91057 is formed such that two-channel heat transfer tubes are arranged so as to separately pass through two plate fin blocks, respectively. Thus, even if such a configuration is employed, the above-described problems still cannot be appropriately solved. In order to increase the hot-water supply capability in each channel, plate fins still need to be increased in size.

The present invention has been devised under the above-described circumstances. An object of the present invention is to provide: a heat exchanger capable of increasing the amount of heat recovered from gas for heating such as combustion gas without using, as a plate fin, a special-purpose plate fin formed considerably long in the right-and-left width direction; and a water heater including this heat exchanger.

Solution to Problem

In order to solve the above-described problems, the present invention employs the following technical means.

A fin-and-tube type heat exchanger of the present invention includes a case, a plurality of plate fins, and a heat transfer tube. The case is configured such that gas for heating is supplied thereinto. The plurality of plate fins are housed in the case and arranged in a fore-and-aft direction of the case. The heat transfer tube includes a plurality of straight-type tubular bodies each passing through the plurality of plate fins in the fore-and-aft direction. The heat transfer tube has opposite ends, a first end of which is provided with a water entry port and a second end of which is provided with a hot water delivery port. The plurality of plate fins include a plurality of first plate fins and a plurality of second plate fins that are configured such that each first plate fin and each second plate fin are formed separately from each other and arranged side by side in a right-and-left width direction of the case. The plurality of straight-type tubular bodies include a first straight-type tubular body passing through each of the plurality of first plate fins and a second straight-type tubular body passing through each of the plurality of second plate fins. The heat transfer tube includes a connection tubular body connecting the first straight-type tubular body and the second straight-type tubular body to each other. The heat transfer tube is also configured to pass through an area in which the plurality of first plate fins are arranged and an area in which the plurality of second plate fins are arranged.

The configuration as described above can achieve the following effects.

Specifically, in the present invention, the plurality of first plate fins and the plurality of second plate fins are arranged side by side in the right-and-left width direction of the case, and the heat transfer tube is configured to pass through an area in which the plurality of first plate fins are arranged and an area in which the plurality of second plate fins are arranged. In terms of functionality, the above-described configuration can increase the entire heat recovery amount similarly to the conventional heat exchanger having a configuration in which a heat transfer tube passes through a plurality of plate fins each of which is formed long in the right-and-left width direction. Accordingly, the above-described configuration can suitably accommodate, for example, also to a large-sized burner having a large combustion area, and the like.

Unlike the conventional case, the present invention also has a configuration in which each first plate fin and each second plate fin are arranged side by side in the width direction. Accordingly, in the present invention, each plate fin to be used can be a small-sized plate fin having a size in the width direction that is equal to or less than half of that of the conventional plate fin. Therefore, the manufacturing cost of each plate fin can be reduced, so that the manufacturing cost of the entire heat exchanger can also be reduced.

Further, according to the present invention, each plate fin is reduced in length, thereby achieving an effect of reducing a stress occurring in each part of the heat exchanger due to thermal expansion and the like caused when each plate fin is heated by gas for heating. Therefore, the reliability of the entire heat exchanger can be enhanced to suitably achieve a lengthened durable life, and the like.

In the present invention, preferably, each of the first plate fins is identical in shape, size and material to each of the second plate fins.

According to the above-described configuration, it is not necessary to use a plurality of types of plate fins having different shapes and the like as the plurality of first plate fins and the plurality of second plate fins. Thereby, the manufacturing cost of the entire heat exchanger can be further reduced.

In the present invention, preferably, the case is formed in a frame shape having an upper opening portion and a lower opening portion. The case is configured to allow gas for heating to flow therethrough from a first one of the upper opening portion and the lower opening portion toward a second one of the upper opening portion and the lower opening portion. Each of the plurality of first plate fins has one end portion, to which a first end bent piece is continuously connected. The first end bent piece is configured to protrude from the one end portion in the fore-and-aft direction of the case. The first end bent piece is configured to have a first portion that is in contact with or located close to a first side wall portion of the case. The first end bent piece has a portion that is located downstream of the first portion in a flow of gas for heating, the portion being spaced apart from the first side wall portion such that gas for heating having flown along the first portion can be guided in a direction away from the first side wall portion of the case. The plurality of second plate fins are formed to have a configuration in which the plurality of first plate fins are laterally reversed. A second end bent piece corresponding to the first end bent piece is continuously connected to each of the second plate fins. The second end bent piece is configured to have a second portion that is in contact with or located close to a second side wall portion of the case. The second end bent piece has a portion that is located downstream of the second portion in a flow of gas for heating, the portion being spaced apart from the second side wall portion such that gas for heating having flown along the second portion can be guided in a direction away from the second side wall portion of the case.

According to the above-described configuration, when heat is recovered by causing gas for heating to flow through the heat exchanger from the first opening portion of the upper opening portion and the lower opening portion toward the second opening portion of these opening portions, gas for heating intensively acts on the first side wall portion and the second side wall portion of the case to bring these wall portions into an overheated state, which can be suitably avoided by the existence of the first and second end bent pieces.

Also, each of the second plate fins is formed to have a configuration in which each of the first plate fins is laterally reversed. In this way, the first end bent piece provided in the first plate fin is effectively utilized, without being modified, as the second end bent piece in the second plate fin. Therefore, such a configuration is reasonable.

In the present invention, preferably, each of the plurality of first plate fins includes a first center-side bent piece at an end thereof located close to a center portion of the case in the right-and-left width direction. The first center-side bent piece is configured to protrude from the end in the fore-and-aft direction of the case. Each of the plurality of second plate fins includes a second center-side bent piece at an end thereof located close to the center portion of the case in the right-and-left width direction. The second center-side bent piece is configured to protrude from the end in the fore-and-aft direction of the case. The first and second center-side bent pieces are configured such that gas for heating having flown toward the first and second center-side bent pieces collides with at least one of the first and second center-side bent pieces, thereby causing gas for heating to be guided toward a pair of straight-type tubular bodies located on opposite sides of the first and second center-side bent pieces.

According to the above-described configuration, a prescribed straight-type tubular body of the heat transfer tube can be efficiently subjected to the effect of gas for heating that has flown toward the first center-side bent piece of each of the first plate fins and toward the second center-side bent piece of each of the second plate fins. Thereby, the heat recovery amount can be further more increased.

In the present invention, preferably, a portion of each of the first plate fins that extends in the right-and-left width direction is arranged so as to be displaced in the fore-and-aft direction from an extension line extending in the right-and-left width direction from a portion of each of the second plate fins that extends in the right-and-left width direction.

Thereby, even if the first plate fins and the second plate fins thermally expand and thereby interfere with each other, these plates fins are less likely to be distorted. Also, the plurality of first plate fins and the plurality of second plate fins can be readily housed in a small case, so that the heat exchanger can be reduced in size.

A water heater according to the present invention includes: a burner; and a heat exchanger configured to heat water by recovering heat from gas for heating generated by the burner. The heat exchanger of the present invention as described above is used as the heat exchanger.

According to the above-described configuration, the water heater of the present invention can also achieve the effect similar to that described with regard to the heat exchanger of the present invention.

Other characteristics and advantages of the present invention will become more apparent from the explanation about the embodiment of the invention described below with reference to the accompanying drawings.

Advantageous Effects of Invention

As described above, according to the present invention, it becomes possible to implement: a heat exchanger capable of increasing the amount of heat recovered from gas for heating such as combustion gas without having to use a special-purpose plate fin, as a plate fin, that is formed considerably long in the right-and-left width direction; and a water heater including this heat exchanger.

DESCRIPTION OF EMBODIMENTS

The preferable embodiments of the present invention will be hereinafter specifically described with reference to the accompanying drawings.

Figure 1:
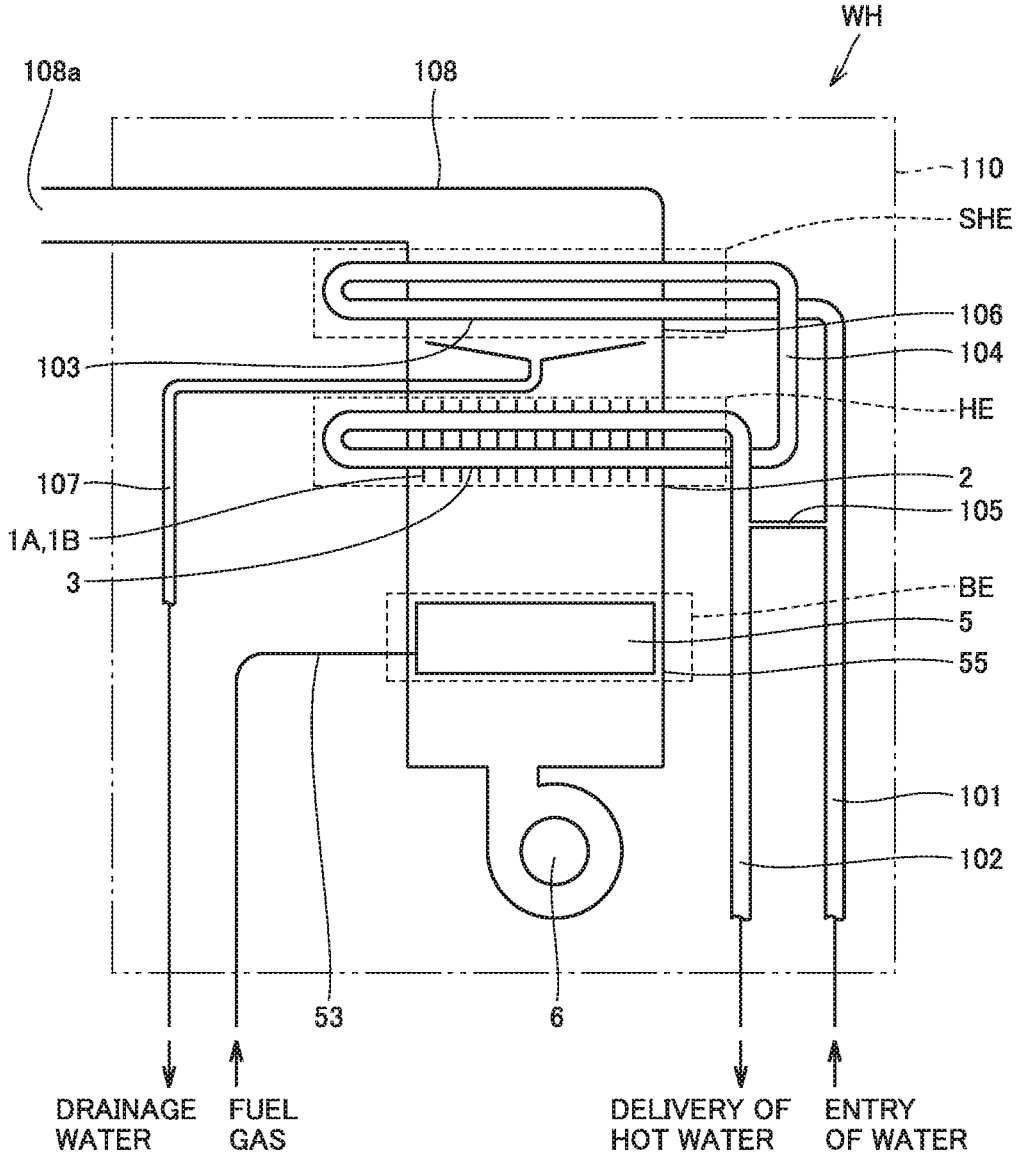
FIG. 1 is a front view schematically showing an example of a water heater according to the present invention.

As shown in FIG. 1, a water heater WH of the present embodiment is an instantaneous gas water heater. This water heater WH mainly includes a housing 110, a combustion apparatus BE, a fan 6, a primary heat exchanger HE, a secondary heat exchanger SHE, and an exhaust collection and guide member 108.

Combustion apparatus BE serves to supply combustion gas. This combustion apparatus BE has a burner 5 and a burner case 55. Burner 5 serves to generate combustion gas. Burner case 55 houses burner 5 therein. A header 53 for supplying fuel gas to combustion apparatus BE is connected to combustion apparatus BE.

Figure 3:
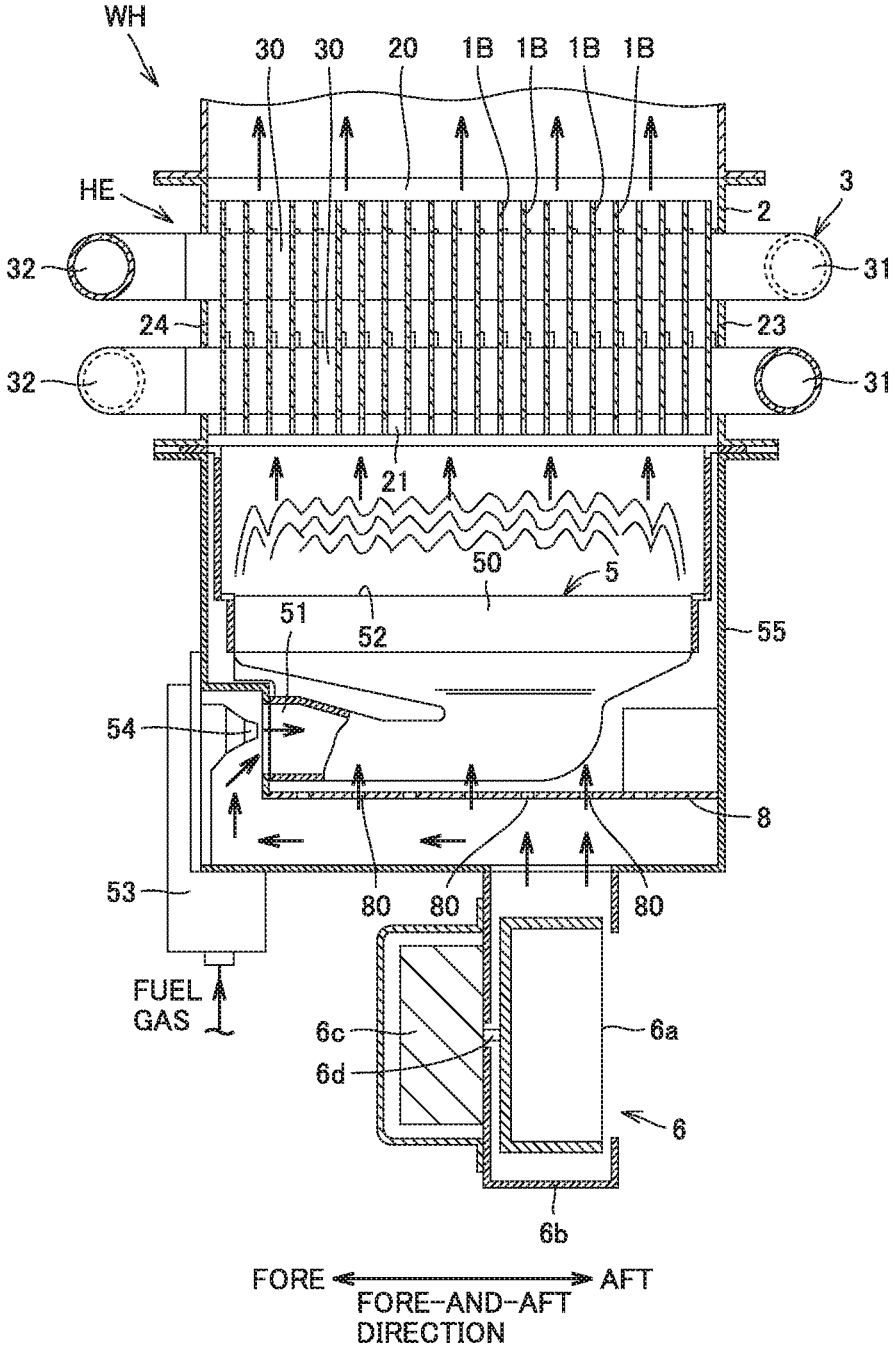
FIG. 3 is a cross-sectional view taken along in FIG. 2.

Fan 6 serves to supply combustion air into burner case 55 of combustion apparatus BE. Fan 6 is a sirocco fan, for example. As shown in FIG. 3, for example, fan 6 has an impeller 6*a*, a fan case 6*b*, a fan motor 6*c*, a rotation shaft 6*d*, and the like. This fan 6 is provided below burner 5.

As shown in FIG. 1, each of primary heat exchanger HE and secondary heat exchanger SHE serves to recover heat from combustion gas generated by burner 5. Primary heat exchanger HE is a heat exchanger for sensible heat recovery while secondary heat exchanger SHE is a heat exchanger for latent heat recovery. Primary heat exchanger HE is provided above combustion apparatus BE, and secondary heat exchanger SHE is provided above this primary heat exchanger HE.

Primary heat exchanger HE and secondary heat exchanger SHE are connected through a pipe 104. A water supply pipe 101 for supplying water to secondary heat exchanger SHE is connected to secondary heat exchanger SHE. A hot water delivery pipe 102 for delivering hot water from primary heat exchanger HE is connected to primary heat exchanger HE.

A bypass pipe 105 is connected between water supply pipe 101 and hot water delivery pipe 102 described above. This bypass pipe 105 serves to adjust the temperature of hot water delivered from hot water delivery pipe 102 using water flowing through water supply pipe 101. Furthermore, a drainage water discharge pipe 107 for discharging drainage water produced in secondary heat exchanger SHE is provided.

Primary heat exchanger HE is a fin-and-tube type heat exchanger. This primary heat exchanger HE has: a plurality of plate fins 1A are stacked each other; a plurality of plate fins 1B are stacked each other; a heat transfer tube 3 that passes through the plurality of plate fins 1A and 1B; and a shell plate as a case 2 in which the plurality of plate fins 1A and 1B and heat transfer tube 3 are housed. Heat transfer tube 3 has one end connected to pipe 104 and the other end connected to hot water delivery pipe 102.

Secondary heat exchanger SHE has a plurality of (spiral-shaped) heat transfer tubes 103 and a case 106 housing heat transfer tube 103 therein. Heat transfer tube 103 has one end connected to water supply pipe 101 and the other end connected to pipe 104.

Exhaust collection and guide member 108 serves to emit combustion gas, which has passed through primary heat exchanger HE and secondary heat exchanger SHE, from a predetermined exhaust port 108*a* to the outside of water heater WH. This exhaust collection and guide member 108 is arranged above secondary heat exchanger SHE. Exhaust port 108*a* may be directly provided in secondary heat exchanger SHE.

In addition, the heat exchanger according to the present invention (claims) corresponds to primary heat exchanger HE but does not correspond to secondary heat exchanger SHE. Also, secondary heat exchanger SHE may be omitted.

Figure 2:
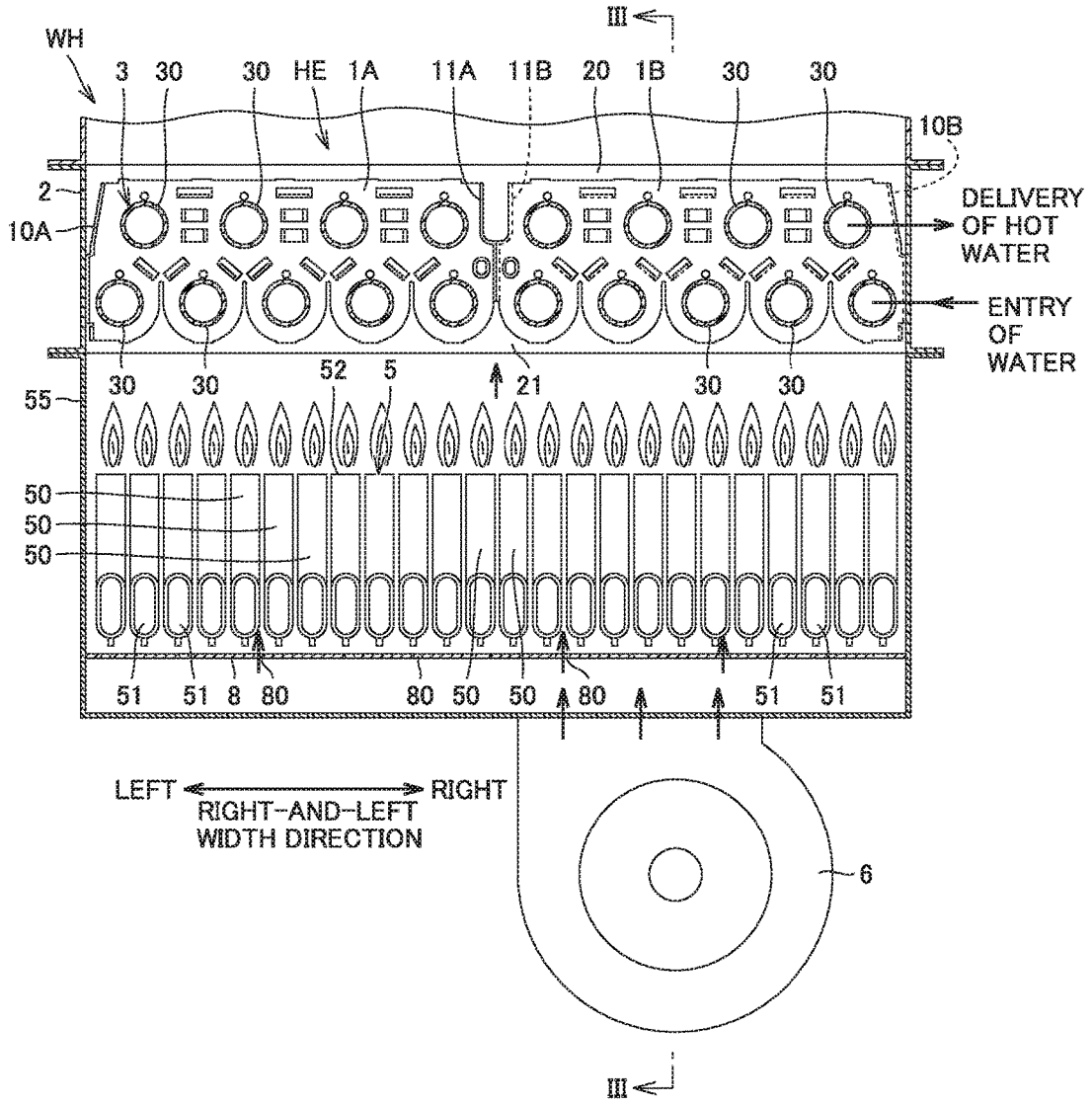
FIG. 2 is a front cross-sectional view showing a part of an example of the water heater according to the present invention.

As shown in FIGS. 2 and 3, primary heat exchanger HE is a commercial-use heat exchanger having hot-water supply capability higher than that achieved, for example, by a standard water heater for home-use.

Burner 5 is, for example, a gas burner and includes a plurality of burner bodies 50 (combustion tubes) arranged side by side in the right-and-left width direction of burner case 55. Each of burner bodies 50 to be used can be similar to a conventional burner body. Although the details of burner body 50 will not be described, the entire burner body 50 is formed in a flat shape. Burner body 50 has a fuel gas inlet port 51 at its lower portion on one side thereof and a burner port portion 52 at its upper portion thereof. This burner port portion 52 is formed in an elongated rectangular shape in plan view. Fuel gas burns at this burner port portion 52.

As shown in FIG. 3, a header 53 for fuel gas supply is attached to a front part of burner case 55. A nozzle 54 provided in this header 53 and used for fuel gas ejection faces or is introduced into each fuel gas inlet port 51 of burner 5. The combustion air (primary air) supplied from fan 6 into burner case 55 is guided by a straightening vane 8 to the vicinity of nozzle 54. The mixture gas made of this combustion air and fuel gas is supplied through fuel gas inlet port 51 into burner body 50. In addition, the combustion air supplied from fan 6 also includes combustion air (secondary air) having passed through a plurality of air vents 80 provided in straightening vane 8. This combustion air (secondary air) is supplied to a region in which burner 5 is arranged.

As shown in FIGS. 2 and 3, heat exchanger HE is a heat exchanger for sensible heat recovery. As described above, heat exchanger HE includes: a case (can body) 2 placed above burner case 55; a plurality of first plate fins 1A and a plurality of second plate fins 1B housed within this case 2; and a heat transfer tube 3. Each of these components 1A, 1B, 2, and 3 in heat exchanger HE is made of copper.

Case 2 is formed in a rectangular frame shape having an upper opening portion 20 and a lower opening portion 21. The combustion gas produced by burner 5 flows through lower opening portion 21 into case 2, and moves upward, and then flows through upper opening portion 20 to the upward from case 2.

The plurality of first plate fins 1A are located in a left side region within case 2 and arranged side by side in the fore-and-aft direction of case 2. The plurality of second plate fins 1B are located in a right side region within case 2 and arranged side by side in the fore-and-aft direction of case 2.

The plurality of first plate fins 1A and the plurality of second plate fins 1B are formed separately from each other. The plurality of first plate fins 1A and the plurality of second plate fins 1B are arranged such that each first plate fin 1A and each second plate fin 1B are located side by side in the right-and-left width direction of case 2.

The above-described right-and-left width direction corresponds to a direction in which the plurality of burner bodies 50 are arranged side by side, as shown in FIG. 2. Also, the above-described fore-and-aft direction corresponds to a direction orthogonal to the right-and-left width direction, and also corresponds to an elongated longitudinal direction of burner port portion 52 formed in an elongated rectangular shape in plan view, as shown in FIG. 3.

As shown in FIG. 2, the longitudinal direction of each first plate fin 1A and the longitudinal direction of each second plate fin 1B extend along the above-described right-and-left width direction. A portion of each first plate fin 1A in the short side direction faces a portion of each second plate fin 1B in the short side direction.

Figure 6:
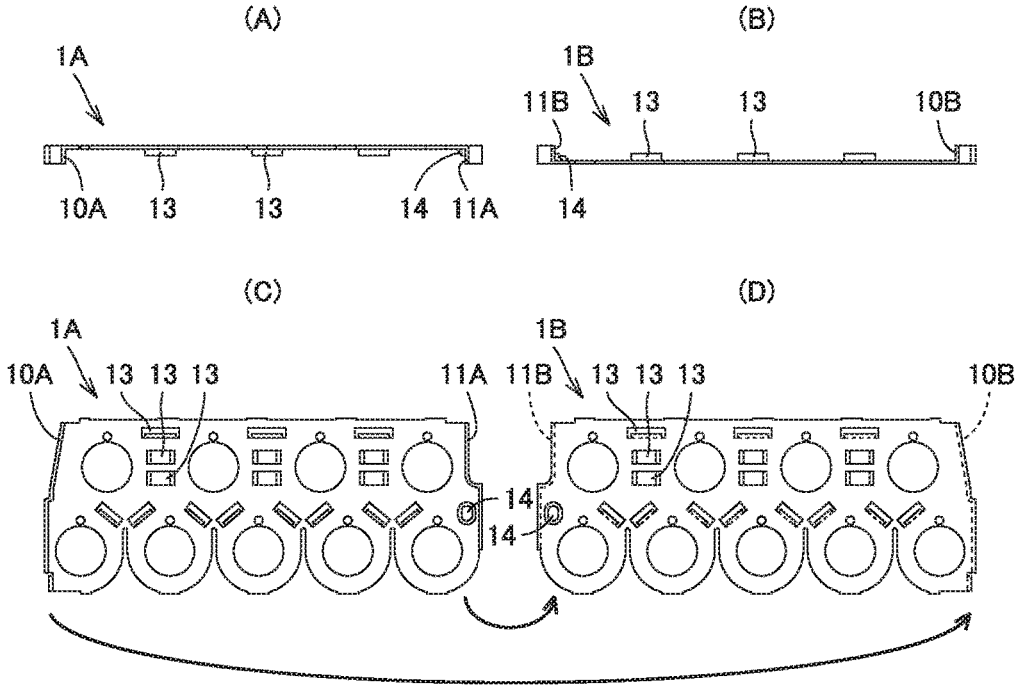
FIGS. 6(A) and 6(C) are a plan view and a front view, respectively, of the first plate fin.
FIGS. 6(B) and 6(D) are a plan view and a front view, respectively, of the second plate fin.

First plate fin 1A and second plate fin 1B have ends that are located close to the center portion of case 2, and that are in contact with or located close to each other. In this situation, the plurality of first plate fins 1A and the plurality of second plate fins 1B each are formed by subjecting a thin-sheet copper plate to press working. Also, first plate fins 1A are substantially identical in shape, size and material to second plate fins 1B. In other words, substantially only one type of a plate fin is used as each of plate fins 1A and 1B used in heat exchanger HE. It is to be noted that second plate fin 1B is arranged so as to correspond to a configuration in which first plate fin 1A is laterally reversed (the front and rear sides are reversed but no vertical flipping) (also see FIG. 6).

First plate fin 1A has opposite ends in the right-and-left width direction, one of which is provided with a first end bent piece 10A, and the other of which is provided with a center-side bent piece (first center-side bent piece) 11A. First end bent piece 10A and center-side bent piece 11A each are obtained by bending the opposite ends of first plate fin 1A in the front direction or the rear direction of case 2. As described above, second plate fin 1B is arranged so as to correspond to a configuration in which first plate fin 1A is laterally reversed. Accordingly, this second plate fin 1B has a second end bent piece 10B and a center-side bent piece (second center-side bent piece) 11B as pieces corresponding to first end bent piece 10A and center-side bent piece 11A, respectively.

Figure 5:
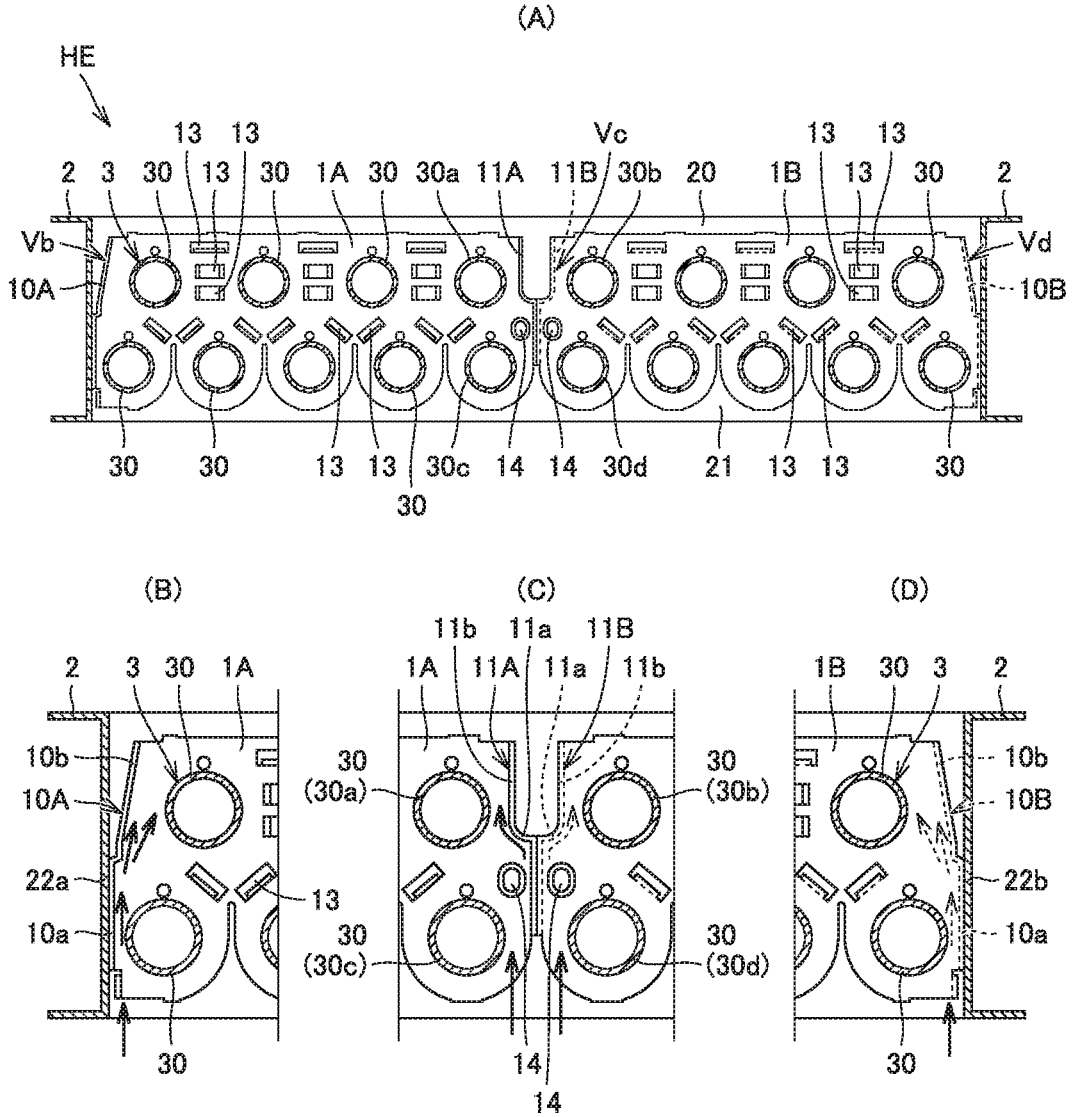
FIG. 5(A) is a cross-sectional view taken along Va-Va in FIG. 4, and FIGS. 5(B), 5(C) and 5(D) are enlarged views of a Vb portion, a Vc portion and a Vd portion, respectively, in FIG. 5(A).

As better shown in FIG. 5(B), first end bent piece 10A has: a lower portion 10*a* that is in contact with or located close to one side wall portion 22*a* of case 2; and an upper portion 10*b* that is located higher than this lower portion 10*a* (a portion located downstream in a flow of gas for heating). This upper portion 10*b* is inclined so as to be distanced away from one side wall portion 22*a* to the upward. Similarly, as better shown in FIG. 5(D), second end bent piece 10B has: a lower portion 10*a* that is in contact with or located close to the other side wall portion 22*b* of case 2; and an upper portion 10*b* that is located higher than this lower portion 10*a*. This upper portion 10*b* is inclined so as to be distanced away from the other side wall portion 22*b* to the upward. As described later, such a configuration is useful in suppressing the combustion gas from flowing along side wall portions 22*a* and 22*b* of case 2.

As shown in FIG. 5(C), each of first and second center-side bent pieces 11A and 11B has a slightly-short and approximately horizontal portion 11*a* having a downward surface and an upright portion 11*b* extending upward from one end of this approximately horizontal portion 11*a*. These first and second center-side bent pieces 11A and 11B are located close to each other so as to be formed in an approximately U-shape in front view. Accordingly, the combustion gas having flown upward from below approximately horizontal portion 11*a* toward approximately horizontal portion 11*a* is guided by approximately horizontal portion 11*a* toward a pair of straight-type tubular bodies 30 (30*a*, 30*b*) located on opposite sides of approximately horizontal portion 11*a*. Thereby, the combustion gas can be efficiently acted upon the pair of straight-type tubular bodies 30 (30*a*, 30*b*).

As shown in FIGS. 6(A) to 6(C), first and second plate fins 1A and 1B each are provided as appropriate with a plurality of cut-and-raised portions 13 of different shapes and sizes, and a bulging portion 14 (an extruded protrusion). Cut-and-raised portions 13 and bulging portion 14 serve as means for improving the effects and efficiency of the combustion gas for heat transfer tube 3.

Figure 4:
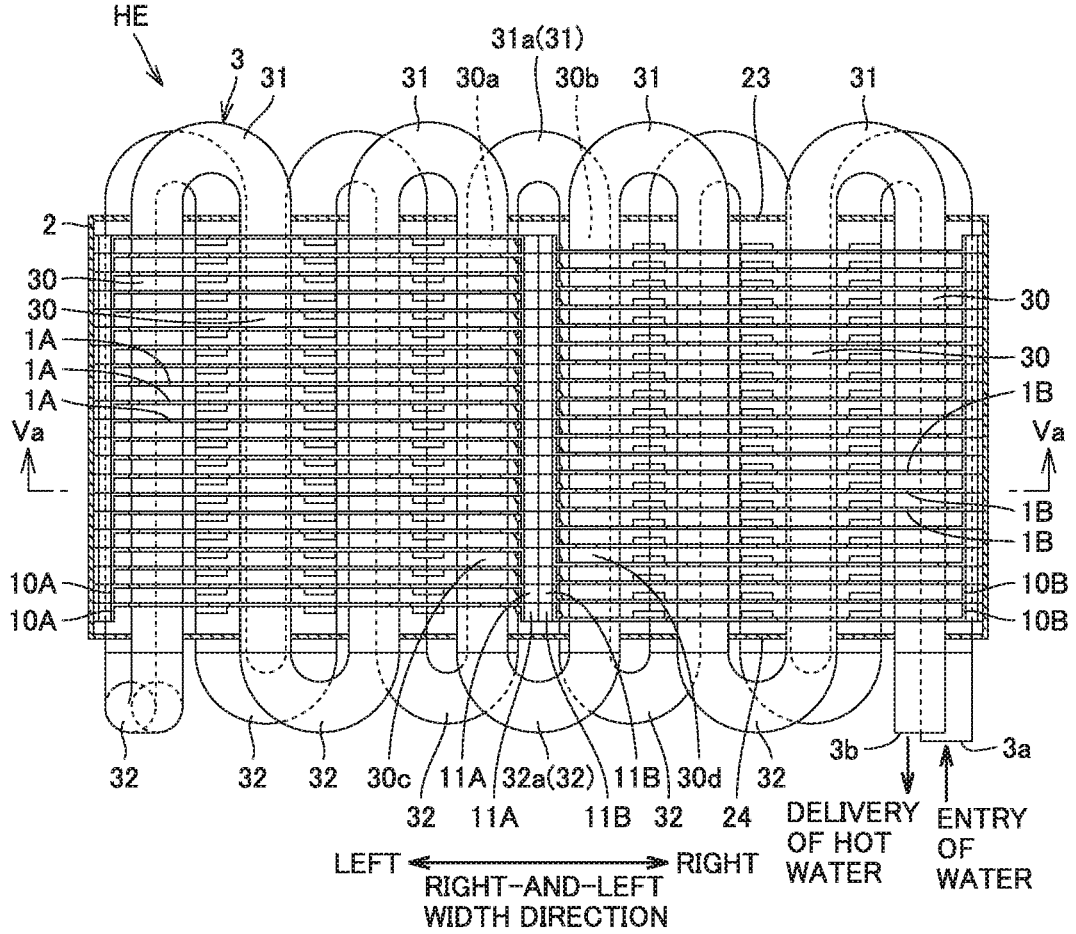
FIG. 4 is a plan cross-sectional view of a heat exchanger of the water heater shown in FIG. 2.

As shown in FIG. 4, heat transfer tube 3 has a plurality of straight-type tubular bodies 30 and a plurality of connection tubular bodies 31 and 32. The plurality of straight-type tubular bodies 30 are arranged to pass through first plate fins 1A and second plate fins 1B in their thickness directions so as to be stacked vertically in two stages. The plurality of connection tubular bodies 31 and 32 connect these plurality of straight-type tubular bodies 30 in series. This heat transfer tube 3 has opposite ends in the longitudinal direction, one of which is provided with a water entry port 3*a*, and the other of which is provided with a hot water delivery port 3*b*.

In addition, in the present embodiment, heat transfer tube 3 is formed using members including: more than one U-shaped tube (30, 31); and an approximately semicircular arc-shaped or a U-shaped bend tube (connection tubular body 32). Each of U-shaped tubes (30, 31) is formed of a single member obtained by integrally connecting base end portions of two straight-type tubular bodies 30 through one connection tubular body 31. The approximately semicircular arc-shaped or U-shaped bend tube (connection tubular body 32) is formed of a member different from U-shaped tube (30, 31), and connects the end portions of U-shaped tubes (30, 31).

Each of the plurality of U-shaped tubes (30, 31) passes through a front wall portion 24 from a rear wall portion 23 of case 2. The end portions of the plurality of U-shaped tubes (30, 31) are connected to each other at the front side portion of case 2 through the bend tube (connection tubular body 32).

The above-described direction through which each U-shaped tube (30, 31) passes may be opposite. Specifically, each of the plurality of U-shaped tubes (30, 31) may pass through rear wall portion 23 from front wall portion 24 of case 2. Also, the end portions of the plurality of U-shaped tubes (30, 31) are connected to each other at the rear side portion of case 2 through the bend tube (connection tubular body 32).

The plurality of straight-type tubular bodies 30 includes: a straight-type tubular body 30*a* (straight-type tubular body 30 in the lower stage) located close to the center of case 2 in the right-and-left width direction and passing through first plate fins 1A; and a straight-type tubular body 30*b* (straight-type tubular body 30 in the lower stage) located adjacent to straight-type tubular body 30*a* and passing through second plate fins 1B. These straight-type tubular body 30*a* and straight-type tubular body 30*b* are connected to each other through a connection tubular body 31*a*. Also, the plurality of straight-type tubular bodies 30 includes: a straight-type tubular body 30*c* (straight-type tubular body 30 in the upper stage) located close to the center of case 2 in the right-and-left width direction and passing through first plate fins 1A; and a straight-type tubular body 30*d* (straight-type tubular body 30 in the upper stage) located adjacent to this straight-type tubular body 30*c* and passing through second plate fins 1B. These straight-type tubular body 30*c* and straight-type tubular body 30*d* are connected to each other through a connection tubular body 32*a*. Thereby, as described above, heat transfer tube 3 is configured in such a manner that the plurality of straight-type tubular bodies 30 are connected in series and sequentially pass through an area in which the plurality of first plate fins 1A are arranged and an area in which the plurality of second plate fins 1B are arranged.

Figure 7:
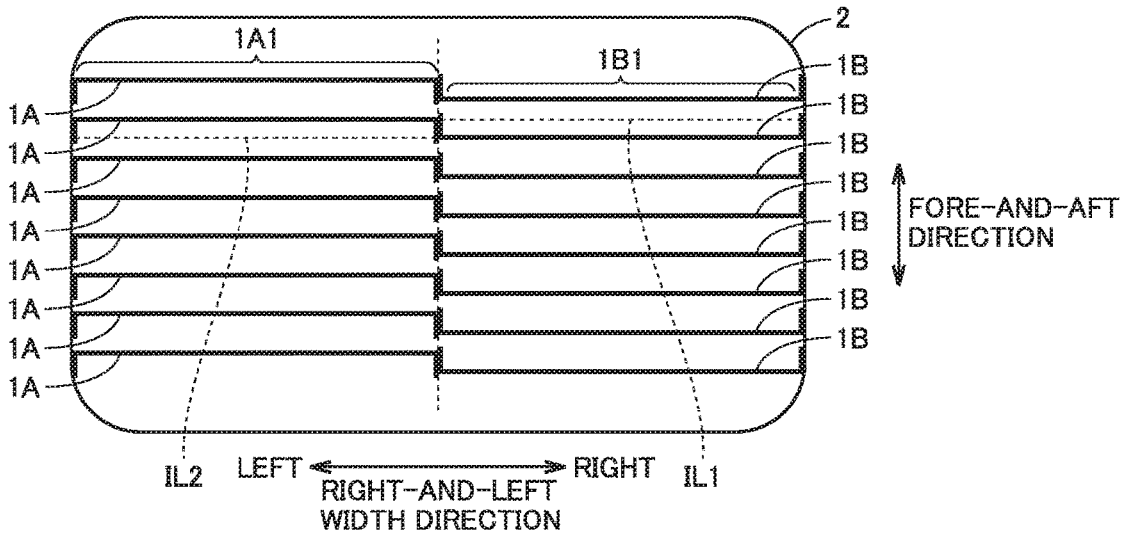
FIG. 7 is a schematic plan view showing a configuration in which a portion of the first plate fin that extends in the right-and-left width direction is located so as to be displaced in the fore-and-aft direction from an extension line extending in the right-and-left width direction from a portion of the second plate fin that extends in the right-and-left width direction.

As shown in FIG. 7, in a plan view, a portion 1A1 of each first plate fin 1A extending in the right-and-left width direction is located so as to be displaced in the fore-and-aft direction from a virtual extension line IL2 extending in the right-and-left width direction from a portion 1B1 of each second plate fin 1B extending in the right-and-left width direction. Also, in a plan view, portion 1B1 of each second plate fin 1B extending in the right-and-left width direction is located so as to be displaced in the fore-and-aft direction from a virtual extension line IL1 extending in the right-and-left width direction from portion 1A1 of each first plate fin 1A extending in the right-and-left width direction.

The plan view used herein means a view of lower opening portion 21 seen from the upper opening portion 20 side of case 2, as shown in FIG. 7.

Then, the effects of water heater WH described above will be hereinafter explained.

First, the hot water supply operation is carried by heating water, which is circulating through heat transfer tube 3, by combustion gas generated by burner 5. In the present embodiment, the total size of first and second plate fins 1A and 1B (the size of the heating transfer area) can be set to be relatively large. Therefore, also when large-sized burner 5 having a relatively large fuel combustion area is used, first and second plate fins 1A and 1B can suitably accommodate to a fuel combustion area of large area size. Therefore, according to water heater WH of the present embodiment, the amount of heat recovered from the combustion gas can be significantly increased, so that the hot-water supply capability can be greatly improved.

Also, the plate fins of heat exchanger HE in the present embodiment are increased in size by arranging first plate fins 1A and second plate fins 1B side by side in the width direction of case 2. Accordingly, each of first and second plate fins 1A and 1B can be reduced in size. As first and second plate fins 1A and 1B, for example, a standard-sized plate fin of a heat exchanger used in a home-use water heater can be employed without making any change, or can also be employed while changing only a part of its shape. Accordingly, the size of each plate fin is reduced, so that the manufacturing cost of the entire heat exchanger HE can be reduced.

In particular, first and second plate fins 1A and 1B used in the present embodiment are identical in shape, size and material to each other. Accordingly, as compared with the case where a plurality of types of plate fins are used, the entire manufacturing cost can be further reduced.

As having been described with reference to FIGS. 5(B) and 5(D), first and second end bent pieces 10A and 10B serve to guide the combustion gas having flown upward along side wall portions 22*a* and 22*b* of case 2 so as to be away from side wall portions 22*a* and 22*b*, respectively. Thus, it becomes also possible to suitably prevent combustion gas from excessively acting on side wall portions 22*a* and 22*b* to bring these side wall portions into an overheated state. Furthermore, the combustion gas guided by first and second end bent pieces 10A and 10B is to act on straight-type tubular body 30 located in the vicinity thereof, so that the effect of increasing the heat recovery amount is also achieved. Also, as having been described with reference to FIG. 5(C), first and second center-side bent pieces 11A and 11B serve to cause the combustion gas to actively act upon the pair of straight-type tubular bodies 30 (30*a*, 30*b*). Thus, the above-described configuration is more preferable for increasing the heat recovery amount.

As shown in FIG. 7, in the present embodiment, portion 1A1 of first plate fin 1A extending in the right-and-left width direction and portion 1B1 of second plate fin 1B extending in the right-and-left width direction are located so as to be displaced from each other in the fore-and-aft direction. Thus, even if first plate fins 1A and second plate fins 1B thermally expand and thereby interfere with each other, these plate fins are less likely to be distorted. Furthermore, the plurality of first and second plate fins 1A and 1B can readily be housed in small case 2, so that heat exchanger HE can be reduced in size, which will be hereinafter described with reference to a comparison with a comparative example shown in FIG. 8.

Figure 8:
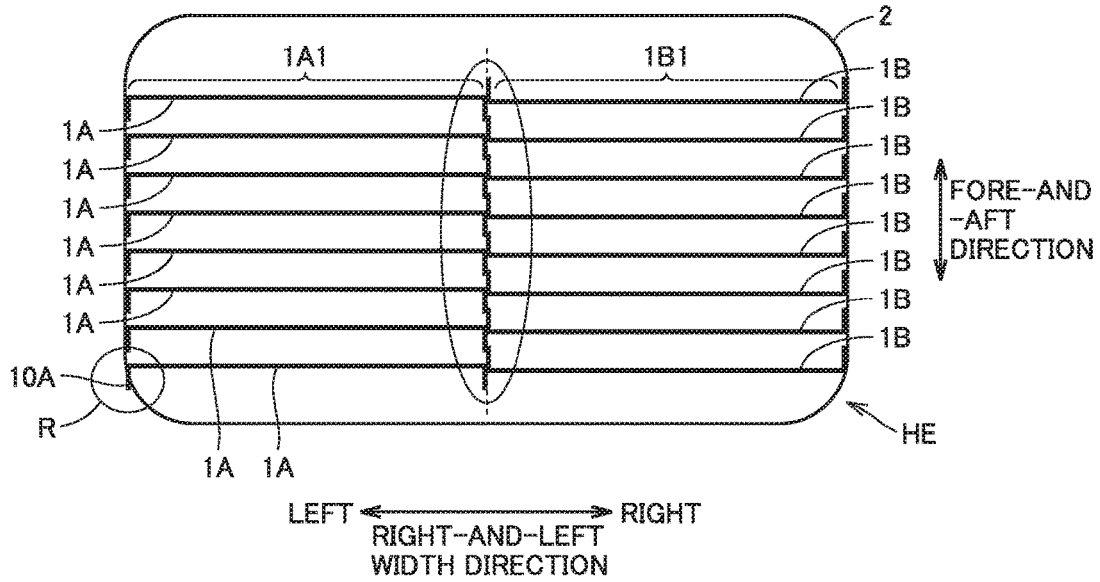
FIG. 8 is a schematic plan view showing a configuration in which a portion of the first plate fin that extends in the right-and-left width direction is located in the right-and-left width direction of a portion of the second plate fin that extends in the right-and-left width direction.

In the comparative example shown in FIG. 8, portion 1B1 of each second plate fin 1B extending in the right-and-left width direction is located along an extension line extending in the right-and-left width direction from portion 1A1 of each first plate fin 1A extending in the right-and-left width direction. In this configuration, when each of first and second plate fins 1A and 1B thermally expands, portion 1A1 of each first plate fin 1A extending in the right-and-left width direction and portion 1B1 of each second plate fin 1B extending in the right-and-left width direction are to interfere with each other and thereby push against each other in the right-and-left width direction. Thereby, since each of first and second plate fins 1A and 1B receives compression force in the right-and-left width direction, each of first and second plate fins 1A and 1B is more likely to be distorted due to this compression force.

Also in the comparative example, as shown in a region R, at least any one of first and second end bent pieces 10A and 10B may not be housed in case 2. Accordingly, in order to house both of first and second end bent pieces 10A and 10B in case 2, this case 2 needs to be increased in size in the fore-and-aft direction. In this situation, heat exchanger HE is increased in size. Alternatively, the number of first plate fins 1A needs to be reduced by the number of first plate fins that cannot be housed in case 2. In this situation, the required thermal efficiency may not be achieved.

On the other hand, in the present embodiment, as shown in FIG. 7, portion 1A1 of first plate fin 1A extending in the right-and-left width direction and portion 1B1 of second plate fin 1B extending in the right-and-left width direction are located so as to be displaced from each other in the fore-and-aft direction. Thus, even when each of first and second plate fins 1A and 1B thermally expands, portion 1A1 of first plate fin 1A extending in the right-and-left width direction and portion 1B1 of second plate fin 1B extending in the right-and-left width direction do not push against each other in the right-and-left width direction. Thereby, each of first and second plate fins 1A and 1B is less likely to receive compression force in the right-and-left width direction, and thereby, less likely to be distorted.

Also in the present embodiment, portion 1A1 of first plate fin 1A extending in the right-and-left width direction and portion 1B1 of second plate fin 1B extending in the right-and-left width direction are located so as to be displaced from each other in the fore-and-aft direction. Thus, first and second center-side bent pieces 11A and 11B can be overlapped with each other by a prescribed size in the fore-and-aft direction. Thereby, the size of the entire area in the fore-and-aft direction in which first and second plate fins 1A and 1B are arranged can be reduced as compared with that in the comparative example. Therefore, the plurality of first and second plate fins 1A and 1B can readily be housed in small case 2, so that heat exchanger HE can be reduced in size. Furthermore, the thermal efficiency can be improved as compared with that in the comparative example.

The present invention is not limited to the features in the above-described embodiment. A specific configuration of each part in the heat exchanger according to the present invention and the water heater can be freely changed in design in various manners within a scope in which the present invention is intended.

In the above-described embodiment, first and second plate fins are identical in shape, size and material to each other, but the present invention is not limited thereto. For example, the first plate fin and the second plate fin can be formed so as to have different shapes, sizes and the like. Furthermore, the plurality of first plate fins do not have to be identical in shape and size to each other while the plurality of second plate fins do not have to be identical in shape and size to each other. Some of the plurality of first plate fins may be different in shape or the like from other first plate fins. The same may applies to the second plate fins.

In the above-described embodiment, the first plate fins and the second plate fins establish a laterally reversed relation, but the present invention is not limited thereto. The heat transfer tube only has to be formed such that a plurality of straight-type tubular bodies are connected to pass through an area in which first plate fins are arranged and an area in which the second plate fins are arranged, but the number of stages of the straight-type tubular bodies (the numbers of stages such as vertically stacked two stages) is also not limited. In the present invention, the third plate fin can be further provided in addition to the first and second plate fins.

The fore-and-aft direction and the right-and-left width direction of the case which are used in the present invention do not necessarily correspond to the fore-and-aft direction and the right-and-left width direction of the water heater.

In the above-described embodiment, a so-called forward combustion system is employed, in which a heat exchanger is provided above a burner such that combustion gas flows from below the heat exchanger to the upward. On the other hand, a reverse combustion system can also be employed, in which a heat exchanger is provided below the burner such that combustion gas flows from above to the downward. The burner to be used is not limited to a gas burner but can be an oil burner, for example. The present invention is suitable to the situation where a commercial-use water heater with high hot-water supply capability is formed, but is not limited thereto, and a specific level of the hot-water supply capability is also not limited. The present invention can achieve the effect of suitably reducing the size of each plate fin. The water heater according to the present invention represents a wide concept of a water heater for generally-used hot water supply, for bath hot water supply, for heating, for snow melting, or the like. Gas for heating is not limited to combustion gas.

REFERENCE SIGNS LIST

BE combustion apparatus, WH water heater, HE heat exchanger (fin-and-tube type heat exchanger), SHE secondary heat exchanger, 1A first plate fin, 1B second plate fin, 10A first end bent piece, 10B second end bent piece, 11A first center-side bent piece, 11B second center-side bent piece, 2 case (of a heat exchanger), 20 upper opening portion, 21 lower opening portion, 3 heat transfer tube, 3*a* water entry port, 3*b* hot water delivery port, 30 straight-type tubular body, 31, 31*a*, 32, 32*a* connection tubular body, 5 burner, 50 burner body, 51 fuel gas inlet port, 52 burner port portion, 53 header, 54 nozzle, 55 burner case, 6 fan, 6*a* impeller, 6*b* fan case, 6*c* fan motor, 6*d* rotation shaft, 8 straightening vane.

The invention claimed is:

1. A fin-and-tube type heat exchanger, comprising:

a case configured such that gas for heating is supplied thereinto;

a plurality of plate fins housed in the case and arranged in a fore-and-aft direction of the case; and a heat transfer tube including a plurality of straight-type tubular bodies each passing through the plurality of plate fins in the fore-and-aft direction, the heat transfer tube having opposite ends, a first end of which is provided with a water entry port and a second end of which is provided with a hot water delivery port, the plurality of plate fins including a plurality of first plate fins and a plurality of second plate fins that are configured such that each first plate fin and each second plate fin are formed separately from each other and arranged side by side in a right-and-left width direction of the case, the plurality of straight-type tubular bodies including a first straight-type tubular body passing through each of the plurality of first plate fins and a second straight-type tubular body passing through each of the plurality of second plate fins, the heat transfer tube including a connection tubular body connecting the first straight-type tubular body and the second straight-type tubular body to each other, the heat transfer tube being configured to pass through an area in which the plurality of first plate fins are arranged and an area in which the plurality of second plate fins are arranged, each of the first plate fins is identical in shape, size and material to each of the second plate fins, the case is formed in a frame shape having an upper opening portion and a lower opening portion, and configured to allow gas for heating to flow therethrough from a first one of the upper opening portion and the lower opening portion toward a second one of upper opening portion and the lower opening portion, each of the plurality of first plate fins has one end portion, to which a first end bent piece is continuously connected, the first end bent piece being configured to protrude from the one end portion in the fore-and-aft direction of the case, the first end bent piece is configured to have a first portion that is in contact with or located close to a first side wall portion of the case, the first end bent piece having a portion that is located downstream of the first portion in a flow of gas for heating, the portion being spaced apart from the first side wall portion such that gas for heating having flown along the first portion can be guided in a direction away from the first side wall portion of the case, the plurality of second plate fins are formed to have a configuration in which the plurality of first plate fins are laterally reversed, a second end bent piece corresponding to the first end bent piece is continuously connected to each of the second plate fins, and the second end bent piece is configured to have a second portion that is in contact with or located close to a second side wall portion of the case, the second end bent piece having a portion that is located downstream of the second portion in a flow of gas for heating, the portion being spaced apart from the second side wall portion such that gas for heating having flown along the second portion can be guided in a direction away from the second side wall portion of the case.

2. A fin-and-tube type heat exchanger, comprising:

a case configured such that gas for heating is supplied thereinto;

a plurality of plate fins housed in the case and arranged in a fore-and-aft direction of the case; and a heat transfer tube including a plurality of straight-type tubular bodies each passing through the plurality of plate fins in the fore-and-aft direction, the heat transfer tube having opposite ends, a first end of which is provided with a water entry port and a second end of which is provided with a hot water delivery port, the plurality of plate fins including a plurality of first plate fins and a plurality of second plate fins that are configured such that each first plate fin and each second plate fin are formed separately from each other and arranged side by side in a right-and-left width direction of the case, the plurality of straight-type tubular bodies including a first straight-type tubular body passing through each of the plurality of first plate fins and a second straight-type tubular body passing through each of the plurality of second plate fins, the heat transfer tube including a connection tubular body connecting the first straight-type tubular body and the second straight-type tubular body to each other, the heat transfer tube being configured to pass through an area in which the plurality of first plate fins are arranged and an area in which the plurality of second plate fins are arranged, each of the plurality of first plate fins includes a first center-side bent piece at an end thereof located close to a center portion of the case in the right-and-left width direction, the first center-side bent piece being configured to protrude from the end in the fore-and-aft direction of the case, each of the plurality of second plate fins includes a second center-side bent piece at an end thereof located close to the center portion of the case in the right-and-left width direction, the second center-side bent piece being configured to protrude from the end in the fore-and-aft direction of the case, and the first and second center-side bent pieces are configured such that gas for heating having flown toward the first and second center-side bent pieces collides with at least one of the first and second center-side bent pieces, thereby causing gas for heating to be guided toward a pair of straight-type tubular bodies located on opposite sides of the first and second center-side bent pieces.

3. A fin-and-tube type heat exchanger, comprising:

a case configured such that gas for heating is supplied thereinto;

a plurality of plate fins housed in the case and arranged in a fore-and-aft direction of the case; and a heat transfer tube including a plurality of straight-type tubular bodies each passing through the plurality of plate fins in the fore-and-aft direction, the heat transfer tube having opposite ends, a first end of which is provided with a water entry port and a second end of which is provided with a hot water delivery port, the plurality of plate fins including a plurality of first plate fins and a plurality of second plate fins that are configured such that each first plate fin and each second plate fin are formed separately from each other and arranged side by side in a right-and-left width direction of the case, the plurality of straight-type tubular bodies including a first straight-type tubular body passing through each of the plurality of first plate fins and a second straight-type tubular body passing through each of the plurality of second plate fins, the heat transfer tube including a connection tubular body connecting the first straight-type tubular body and the second straight-type tubular body to each other, the heat transfer tube being configured to pass through an area in which the plurality of first plate fins are arranged and an area in which the plurality of second plate fins are arranged, and a portion of each of the first plate fins that extends in the right-and-left width direction is arranged so as to be displaced in the fore-and-aft direction from an extension line extending in the right-and-left width direction from a portion of each of the second plate fins that extends in the right-and-left width direction.

4. A water heater comprising:

a burner; and a heat exchanger configured to heat water by recovering heat from gas for heating generated by the burner, the heat exchanger according to claim 1 being used as the heat exchanger.

5. A water heater comprising:

a burner; and a heat exchanger configured to heat water by recovering heat from gas for heating generated by the burner, the heat exchanger according to claim 2 being used as the heat exchanger.

6. A water heater comprising:

a burner; and a heat exchanger configured to heat water by recovering heat from gas for heating generated by the burner, the heat exchanger according to claim 3 being used as the heat exchanger.

* * * * *